US008550320B2

(12) United States Patent
Nakano et al.

(10) Patent No.: US 8,550,320 B2
(45) Date of Patent: Oct. 8, 2013

(54) DRIVING MACHINE

(75) Inventors: Yoshihiro Nakano, Ibaraki (JP); Hiroyuki Oda, Ibaraki (JP); Yukihiro Shima, Ibaraki (JP); Hideyuki Tanimoto, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 722 days.

(21) Appl. No.: 12/202,660

(22) Filed: Sep. 2, 2008

(65) Prior Publication Data

US 2009/0071998 A1 Mar. 19, 2009

(30) Foreign Application Priority Data

Sep. 3, 2007 (JP) ..... P2007-227271

(51) Int. Cl.
*B27F 7/02* (2006.01)

(52) U.S. Cl.
USPC ..... 227/8; 227/130

(58) Field of Classification Search
USPC ..... 227/8, 130, 142, 120
See application file for complete search history.

(56) References Cited

U.S. PATENT DOCUMENTS

| | | | | |
|---|---|---|---|---|
| 3,056,965 | A * | 10/1962 | Rogers | 227/8 |
| 3,873,796 | A * | 3/1975 | Worobec, Jr. | 200/332.2 |
| 4,629,106 | A * | 12/1986 | Howard et al. | 227/8 |
| 5,401,928 | A * | 3/1995 | Kelley | 200/510 |
| 5,593,079 | A * | 1/1997 | Mukoyama et al. | 227/8 |
| 7,004,367 | B1 * | 2/2006 | Shen et al. | 227/8 |
| 2006/0091176 | A1 * | 5/2006 | Cannaliato et al. | 227/8 |

FOREIGN PATENT DOCUMENTS

| | | |
|---|---|---|
| JP | 61-187678 | 11/1986 |
| JP | 7-100306 | 11/1995 |
| JP | 10-230473 | 9/1998 |
| JP | 2005-007547 | 1/2005 |

OTHER PUBLICATIONS

Japanese Notification of Reasons for Refusal, with English translation, issued in Japanese Patent Application No. JP 2007-227271, dated Jan. 20, 2010.

* cited by examiner

*Primary Examiner* — Alexandra Elve
*Assistant Examiner* — Nathaniel Chukwurah
(74) *Attorney, Agent, or Firm* — McDermott Will & Emery LLP

(57) ABSTRACT

According to an aspect of the present invention, there is provided a driving device including: a driver bit for striking a fastener loaded in a launching section; a driver for driving the fastener from the launching section by reciprocating the driver bit; a triggering device pullable to control the driver; and a locking device that locks the pulling operation of the triggering device when being set to a lock position and that releases the locking state when being set to a release position, wherein the locking device includes a release device to operate the locking device toward the release position when the triggering device is pulled and a returning device to return the locking device toward the lock position when the pulling is released.

8 Claims, 10 Drawing Sheets

LOCKING STATE OF LOCK SWITCH

TRIGGER RELEASING STATE

TRIGGER RELEASING STATE

LOCKING STATE OF LOCK SWITCH

MOVING STATE OF LOCK SWITCH

LOCK RELEASING STATE OF LOCK SWITCH

STRIKING STATE BY TRIGGER PULLING OPERATION

STATE IMMEDIATELY AFFER DRIVING BY TRIGGER PULLING OPERATION

STST OF CONTACT ARM RETURNED TO TOP DEAD CENTER BY DRIVING REACTION FORCE

STATE OF CONTACT ARM RETURNED TO TOP DEAD CENTER BY DRIVING REACTION FORCE

STATE IN THE MIDDLE OF TRIGGER RELEASING OPERATION

STATE AFFER COMPLETION OF TRIGGER RELEASING OPERATION

DRIVING MACHINE

CROSS-REFERENCE TO RELATED APPLICATIONS

This application is based upon and claims a priority from prior Japanese Patent Application No. 2007-227271 filed on Sep. 3, 2007, the entire contents of which are incorporated herein by reference.

BACKGROUND OF THE INVENTION

1. Field of the Invention

An aspect of the present invention relates to a driving machine for driving fasteners, such as nails, tacks and staples, into members to be fastened.

2. Description of the Related Art

A portable driving machine is known in which connected fasteners loaded in a magazine are driven from the tip end of a driver guide sequentially one by one using a drive source (power source), such as a pneumatic type in which compressed air is supplied from an air compressor to the main body of the driving machine and the pressure of the air is used; a gas combustion type in which a small gas cylinder is mounted on the main body of the driving machine and the gas stored in the gas cylinder is combusted; or an electric motor type in which a storage battery and an electric motor are mounted on the main body of the driving machine and the drive power of the electric motor is used. In this kind of driving machine, a mechanism having a contact arm extending from the vicinity of the tip end section of the driver guide to the vicinity of the trigger section of the driving machine is generally adopted. With this mechanism, only in the case that the tip end of the contact arm is pushed against a fastened member, such as wood, the other end of the contact arm is retracted upward and engaged with the trigger mechanism, and the operation of the trigger is enabled for the first time. Hence a fastener can be launched and driven into the fastened member by next carrying out the pulling operation of the trigger.

For example, as disclosed in JP-2005-7547-A described above, a mechanism is provided in which in the case that the contact arm thereof is urged toward its top dead center at all times in its initial state and that the tip end section of the contact arm at the tip end of the launching section is not made contact with a fastened member, even if the pulling operation of the trigger is performed, the contact arm is only moved downward and the launching drive section cannot be started. Since the tip end section of the contact arm is not required to be strongly pushed against the fastened member, this technology is advantageous in that the finish and workability of the fastened member are excellent and that the driving efficiency and operability of the driving machine can be improved.

SUMMARY OF THE INVENTION

For the purpose of attaining the above-mentioned objects, the summary of the typical features of the present invention to be disclosed in the present application will be described below.

According to an aspect of the present invention, there is provided a driving device including: a driver bit for striking a fastener loaded in a launching section; driving means for driving the fastener from the launching section by reciprocating the driver bit; triggering means that can be pulled in a given direction to control the start or stop of the driving means; and locking means that can be selectively set to its lock position at which the pulling operation of the triggering means is locked or its release position at which the locking state at the lock position is released and the pulling operation of the triggering means is enabled, wherein the triggering means is connected mechanically or electrically to the driving means, the driving means is held in a stopping state in the case that the locking means is located at the lock position and so that the driving means is switched ON in the case that the locking means is released from the lock position to the release position; and the locking means includes release operation means that is used to operate the locking means from the lock position to the release position each time the pulling operation of the triggering means is carried out and returning means that automatically returns the locking means from the release position to the lock position when the pulling operation of the triggering means is released.

According to another aspect of the present invention, the locking means has a lock button that can be moved in a direction intersectional to the direction of the pulling operation of the triggering means, and the lock button is made movable to carry out the release operation from the lock position to the release position.

According to still another aspect of the present invention, the returning means includes a pushing member for urging the locking means toward the triggering means so that the locking means is engaged with the triggering means at the lock position in the case that the pulling operation of the triggering means is released.

According to still another aspect of the present invention, the driving device further includes a contact arm, one end of which is disposed at the tip end section of the launching section and the other end of which is mechanically connected to the triggering means, wherein in the case that the contact arm makes contact with a fastened member and when the locking means is released from the lock position to the release operation, the driving operation for the fastener is enabled on the basis of the pulling operation of the triggering means.

According to still another aspect of the present invention, the one end of the contact arm is urged using a pushing member in a direction opposite to the launching direction of the fastener.

According to still another aspect of the present invention, the driving means is equipped with an electric motor and a switch for starting the electric motor, and the triggering means turns OFF the switch in the case that the locking means is set at the lock position and turns ON the switch in the case that the locking means is set at the release operation.

According to still another aspect of the present invention, there is provided a driving device including: a housing having a body housing section extending from one end section to the other end section and a handle housing section branching and extending from the body housing section; a launching section provided on the side of the one end section of the body housing section and having a launching passage; a magazine accommodating connected fasteners to feed fasteners to the launching passage; driving means installed inside the body housing section and containing a driver bit for striking a fastener loaded in the launching section; a trigger provided in the handle housing section and being able to be pulled in a given direction; a start switch having a switch plunger disposed at a position in which the switch plunger can make contact with the trigger by the pulling operation of the trigger and urged using first pushing means in a direction opposite to the pulling direction of the trigger and controlling the start of the driving means in the case that a pushing force is received from the trigger against the urging force of the switch plunger; a contact arm extending from its lower end section positioned at the launching section to its upper end section positioned near the trigger in parallel with the movement direction of the driver bit, supported so as to be movable with respect to the launching section and urged toward its top dead center using second pushing means at all times; and a trigger arm rotatably supported via a pivoting section inside the trigger, part of which is disposed so as to be engageable with the switch plunger and the free end section of which makes contact with and engages with the contact arm, wherein the driving device further includes a lock switch positioned near the trigger of the handle housing section, urged from its release position to its lock position using third pushing means and being movable between the two positions, and the lock switch is configured such that the lock switch makes contact with the trigger at the lock position toward which the lock switch is urged using the third pushing means to prevent the pulling operation of the trigger, and such that, on the other hand, when the lock switch is moved from the lock position to the release position against the urging force of the third pushing means, the lock switch is disengaged from the trigger and the pulling operation of the trigger is enabled; and the contact arm is configured such that the contact arm turns ON the start switch in cooperation with the pulling operation of the trigger and such that while the contact arm is in the middle of lowering from the top dead center, the free end section of the trigger arm is disengaged from the upper end section of the contact arm and the contact arm is returned to the top dead center by virtue of the second pushing means.

According to still another aspect of the present invention, the lock switch is disposed orthogonal to the direction of the pulling operation of the trigger, urged toward the lock position at the central section using the third pushing means at all times and moved either left or right direction against the urging force of the third pushing means, whereby the lock switch is moved from the lock position to the release position and disengaged from the trigger, and the pulling operation of the trigger is enabled.

The above-mentioned and other features thereof will be further apparent from the following descriptions and the accompanying drawings of the present specification.

BRIEF DESCRIPTION OF THE DRAWINGS

Embodiments of the present invention will be described in detail based on the following figures, wherein.

DETAILED DESCRIPTION OF THE INVENTION

Figure 1:
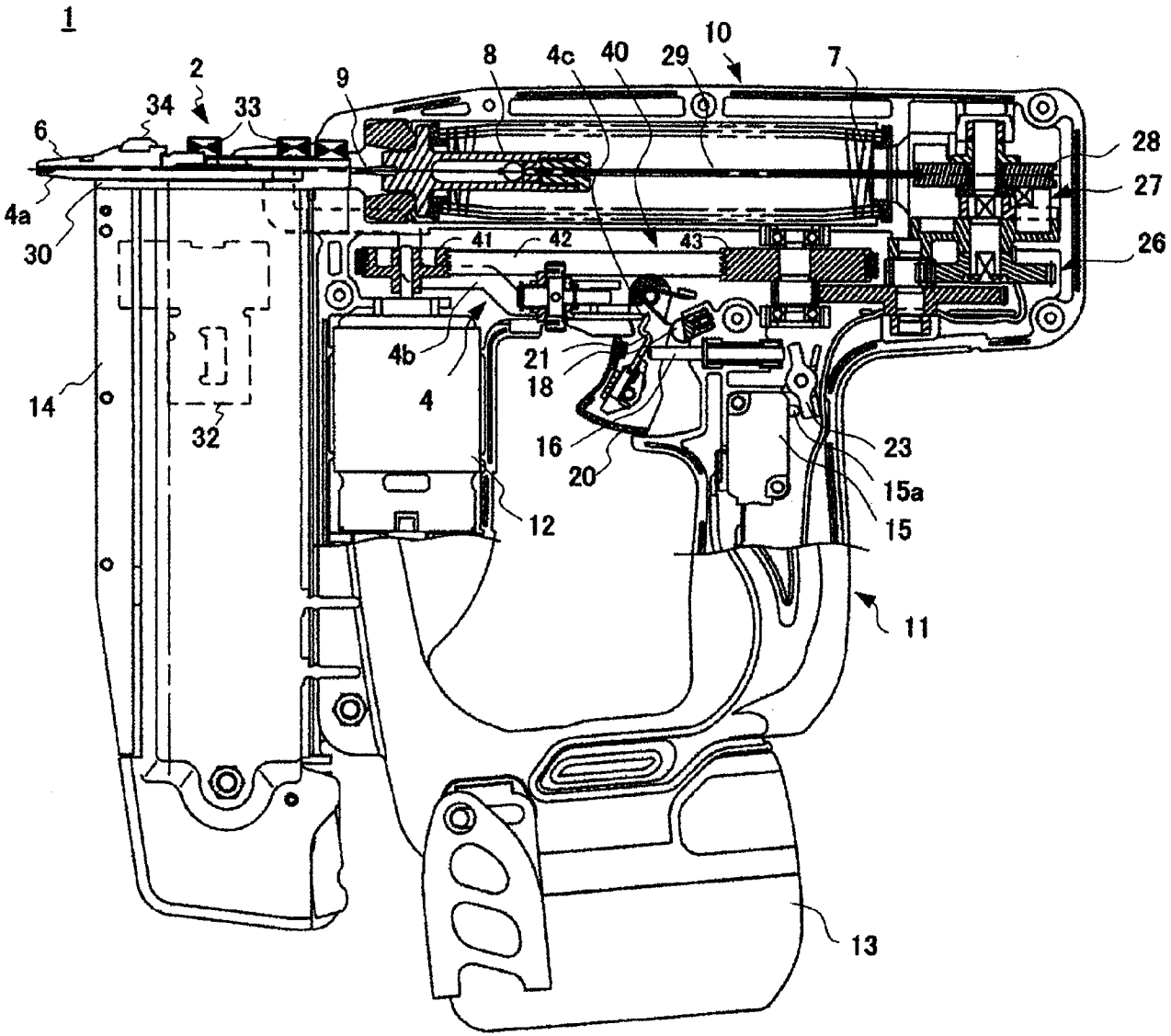
FIG. 1 is a side view showing a driving machine according to an embodiment of the present invention, including a partly sectional view thereof.

An embodiment obtained by applying the present invention to an electric-motor-type driving machine will be described below referring to the drawings. In all the drawings for explaining the embodiment, components having the same functions are designated by the same numerals, and their descriptions are omitted to avoid repeated explanations. Furthermore, in the descriptions regarding the driving machine according to the embodiment, in the state that the driving machine is placed such that the direction in which a fastener is driven is a vertical direction, the direction in which a fastener is driven may be represented as "lower end or downward" and the direction opposite thereto may be represented are "upper end or upward" for the sake of convenience. However, the representations do not limit the spirit of the present invention to particular embodiments or intensions. In the state that the driving machine is placed such that the direction in which a fastener is driven is a horizontal direction, the directions toward the opposing sides in the horizontal direction in which a fastener is driven may be explained as "left direction" and "right direction," and these representations do not limit the spirit of the present invention.

FIGS. 1 to 12 are structural drawings showing the structure of the driving machine according to the embodiment in the operation states thereof. First, the configuration of the driving machine will be described referring to FIGS. 1 to 7. A driving machine 1 includes a body housing section 10; a driver bit 9 for driving fasteners 35 (see FIG. 7) loaded inside a launching section 2 that is described later, accommodated in the body housing section 10 and provided on the lower end side of the body housing section 10; a launching section 2 installed so as to protrude downward from the lower end of the body housing section 10 to launch a fastener 35; a handle housing section 11 provided so as to branch from the body housing section 10; a storage battery (battery pack) 13 removably installed at the end section of the handle housing section 11 and electrically connected to an electric motor 12; and a magazine 14 loaded so as to extend from the launching section 2 in nearly parallel with the handle housing section 11 and loaded with connected fasteners 35*a* (see FIG. 7) to supply the fasteners 35 into the launching section 2 one by one.

The body housing section 10 further includes a transmission mechanism section 40 formed of a pair of friction wheels 41 and 43 and a belt 42 to transmit the rotation power of the electric motor 12 serving as a power source; a deceleration mechanism section 26 for reducing the output rotation speed of the transmission mechanism section 40; a clutch mechanism section 27 for transmitting or cutting off the rotation output reduced using the deceleration mechanism section 26 to a drum 28; and the drum 28 for pulling up a striking plunger 8 connected to a wire 29 from its bottom dead center to its top dead center against the urging force of a striking spring 7.

A start switch 15 for controlling the driving operation of the driving machine 1 and a switch plunger 16 disposed so as to be engageable with the switch button 15*a* of the start switch 15 and used to turn ON the start switch 15 are disposed near the base section of the handle housing section 11. In addition, a trigger (triggering means) 20 that can be activated by pulling operation (pull-in operation) with a finger of the hand holding the outer circumference of the handle housing section 11 is provided near the switch plunger 16.

Figure 6:
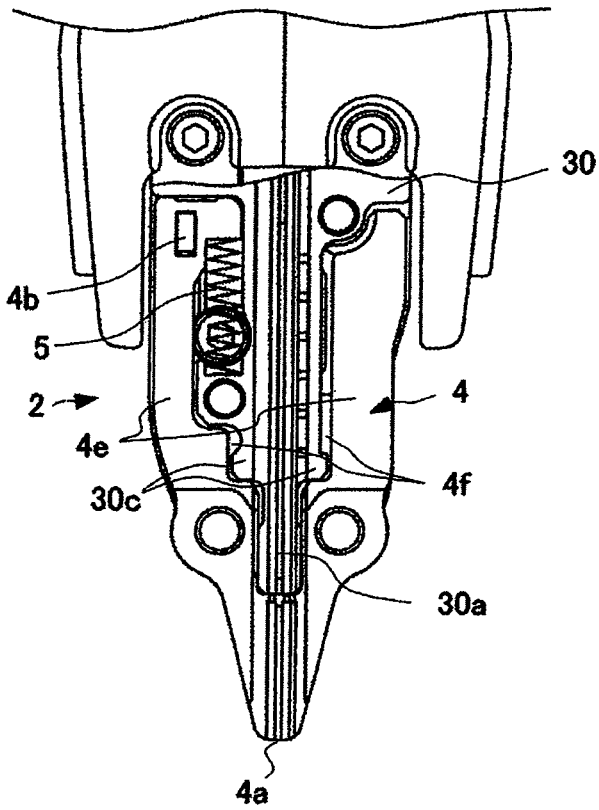
FIG. 6 is a front view showing the tip end section of the contact arm shown in FIG. 1, with a guide plate removed.

A contact arm 4 extends from its tip end section (lower end section) 4*a* located on the tip end side of the launching section 2 to its upper end section located near the trigger 20 and is urged toward the top dead center in the vertically movable direction thereof using a spring 5 as shown in FIG. 6. In this embodiment, the tip end section 4*a* of the contact arm 4 forms part of a launching passage 3 (see FIG. 7) serving as a launching port for the fastener 35 firstly loaded in a feeding passage 30*a* (see FIG. 6), and the tip end section 4*a* is guided using a bit guide 30 (see FIG. 1) constituting the launching section 2 and supported using the bit guide 30 so as to be reciprocally movable.

When the trigger 20 is pulled while it is in a state of cooperation with the contact arm 4, the switch plunger 16 pushes the switch button 15*a* of the start switch 15 provided in the handle housing section 11 via a switch lever 23, and sets the start switch 15 to its ON state. With this ON state, the motor 12 connected to the storage battery 13 operates.

When the motor 12 operates, the rotation output of the motor 12 is transmitted to the deceleration mechanism section 26 via the transmission mechanism section 40. The power of the rotation output, the rotation speed of which is reduced using the deceleration mechanism section 26, rotates the drum 28 via the clutch mechanism section 27 for transmitting or cutting off the power. When the drum 28 is rotated, the wire 29 is begun to be wound around the outer circumference of the drum 28, and the striking plunger 8 is pulled up from its bottom dead center to its top dead center, thereby compressing the striking spring 7. After the drum 28 is rotated by a given rotation angle, the transmission is cut off using the clutch mechanism section 27. When the transmission is cut off using the clutch mechanism section 27, the compressed striking spring 7 strikes the striking plunger 8 and the driver bit 9 installed in the striking plunger 8 toward the bottom dead center. As a result, the driver bit 9 is launched while being guided using the launching passage 3, and the fastener 35 firstly fed into the feeding passage 30*a* (see FIG. 6) is driven from the tip end of the launching passage 3 to a fastened member 36, whereby the fasteners 35 are driven one by one.

In the present invention, a lock switch (lock switching means) 18 capable of switching the pulling operation of the trigger 20 between its enabling and disabling modes is provided in the base section (installation section) 11*a* (see FIG. 3) of the handle housing section 11 near the trigger 20.

Figure 3:
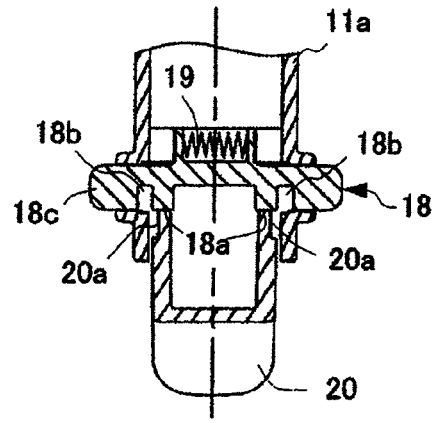
FIG. 3 is a sectional view taken on line A-A of the lock switch section shown in FIG. 2.

As shown in FIG. 3, the lock switch (lock button) 18 is urged using a built-in spring 19 at central section of the base section 11*a* of the handle housing section 11, and both ends of the lock switch 18 protrude from both walls of the base section 11*a* of the handle housing section 11. In this initial state (steady state), the convex sections 18*a* of the lock switch 18 are disposed adjacent behind the wall sections (protruding sections) 20*a* of the trigger 20. Even if the pulling operation of the trigger 20 is attempted, the convex sections 18*a* of the lock switch 18 make contact with the wall sections 20*a* of the trigger 20, whereby the pulling operation of the trigger 20 is disabled. In other words, in the steady state, the lock switch 18 is set at its lock position with respect to the trigger 20.

Figure 4:
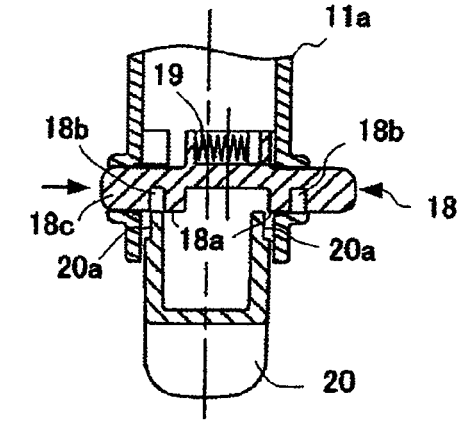
FIG. 4 is a sectional view showing a state in which the movement operation of the lock switch shown in FIG. 3 is carried out.
Figure 5:
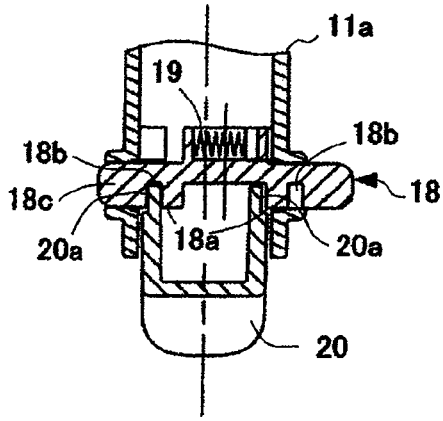
FIG. 5 is a sectional view showing a release state in which the movement operation of the lock switch shown in FIG. 3 is carried out.

As shown in FIGS. 4 and 5, the lock switch 18 can be moved left and right when the user pushes the button protruding section 18*c* against the urging force of the spring 19 in either the left or right direction. For example, when the lock switch 18 is moved by a constant amount in the right direction as shown in FIG. 4, the convex sections 18*a* of the lock switch 18 located behind the wall sections 20*a* of the trigger 20 are replaced with the concave sections 18*b* of the lock switch 18. When the pulling operation of the trigger 20 is attempted after this replacement as shown in FIG. 5, the wall sections 20*a* of the trigger 20 enter the concave sections 18*b* of the lock switch 18, whereby the pulling operation of the trigger 20 is enabled. In other words, in the release state, the lock switch 18 is set at its release position with respect to the trigger 20.

As described above, the lock switch 18 according to the present invention is equipped with the button protruding section 18*c* (release operation means) that is operated from the lock position (contact is made at the convex sections 18*a*) to the release position (contact is made at the concave sections 18*b*) each time the user carries out the pulling operation of the trigger 20 and the spring (returning means) 19 for automatically returning the lock switch 18 from the release position (the concave sections 18*b*) to the lock position (the convex section 18*a*) when the user releases the pulling operation of the trigger 20.

With the lock switch 18 configured as described above, since the button protruding section 18*c* of the lock switch 18 is operated in a direction orthogonal or intersectional to the direction of the pulling operation of the trigger 20, while the lock button protruding section 18*c* is pushed to the release position with a finger, such as the thumb of the hand holding the handle housing section 11, the pulling operation of the trigger 20 is enabled with another finger, such as the index finger, whereby the release of the lock switch 18 can be accomplished very easily. Conversely, when the lock switch 18 is returned to the lock position, the lock switch 18 is automatically returned to the lock position by the action of the spring 19 by completely releasing the finger used for the pulling operation of the trigger 20, whereby operability can be improved. In particular, since the structure is configured such that the locking is carried out automatically only by releasing the pulling of the trigger 20, operability can be further improved. Furthermore, since the release of the lock switch 18 can be carried out by pressing the button protruding section 18*c* in either the left or right direction, the operation can be done with either left or right hand holding the handle of the driving machine.

Figure 2:
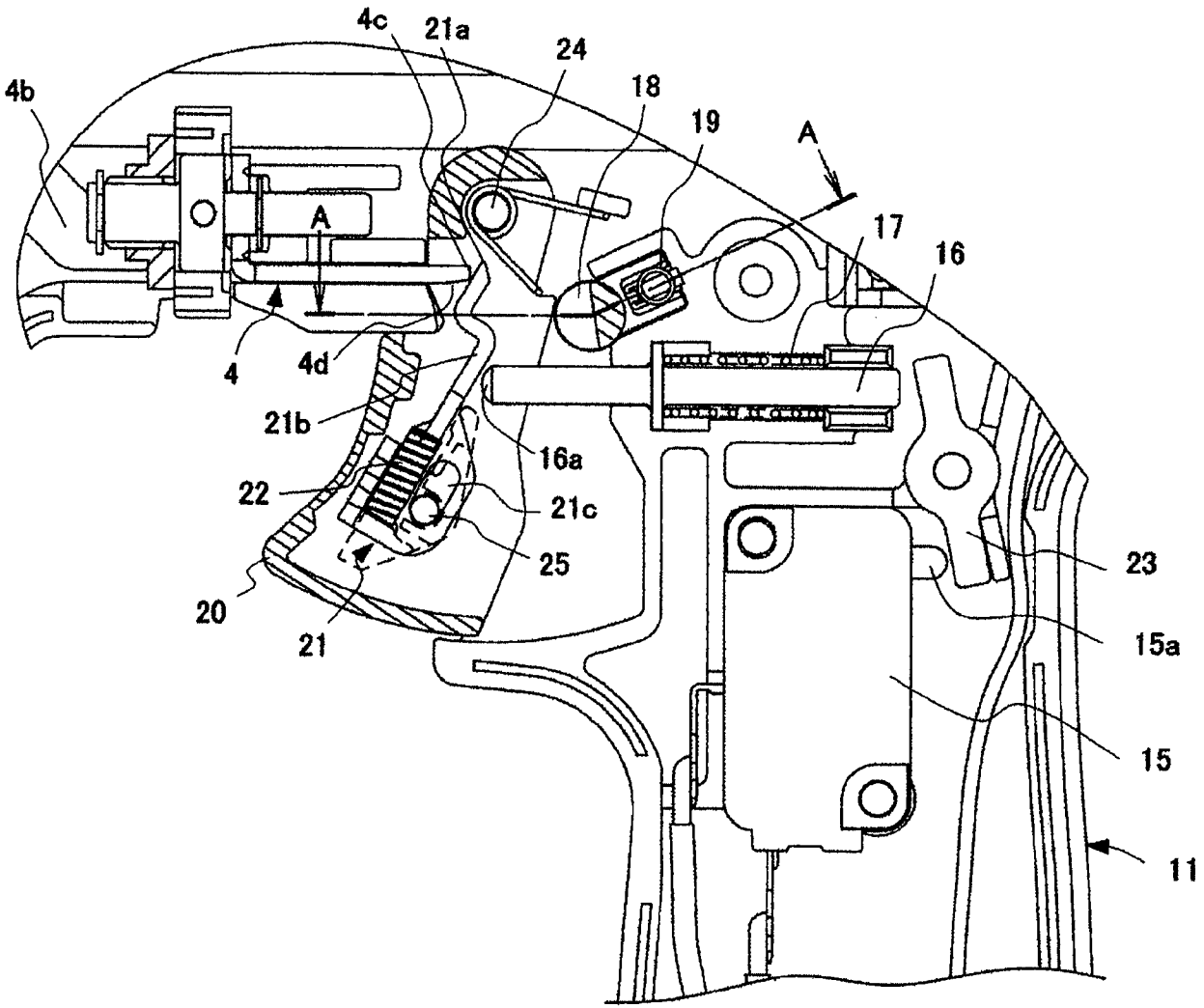
FIG. 2 is an enlarged sectional view enlargedly showing the trigger section of the driving machine shown in FIG. 1.
Figure 10:
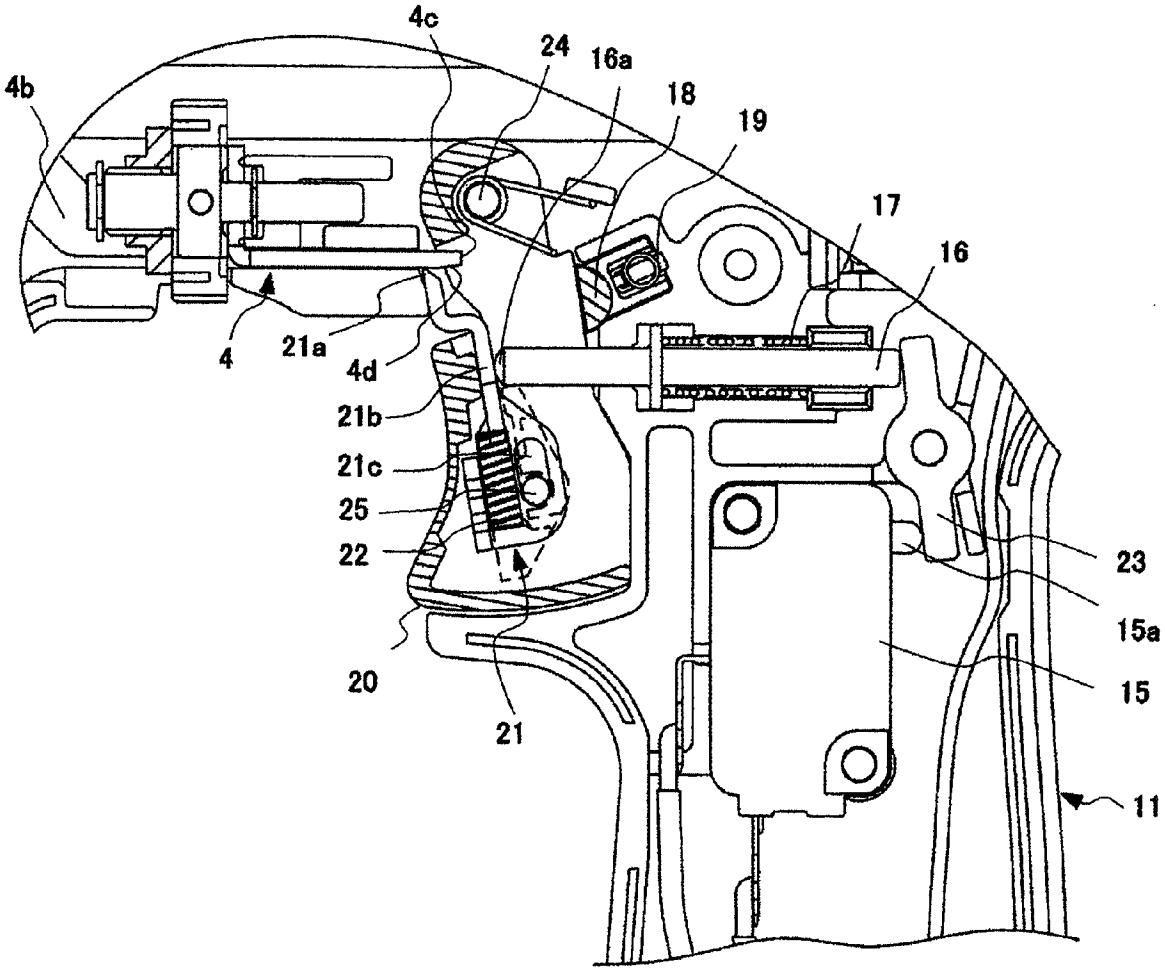
FIG. 10 is an enlarged sectional view enlargedly showing the trigger section shown in the side view of FIG. 9.

As shown in FIG. 2 (a partly enlarged view of FIG. 1), the trigger 20 is supported in the body housing section 10 so as to be rotatable around a rotating shaft 24 serving as a fulcrum. A trigger arm 21 having a slot 21*c* is provided for the trigger 20 so as to be slidable back and forth while being pivoted at a pivoting section 25, one end of which is installed in the trigger 20. The trigger arm 21 is pushed forward, that is, toward the rotating shaft 24, using a spring 22 at all times. The trigger arm 21 is configured such that at the forefront position thereof the free end section 21*a* of the trigger arm 21 is engaged with the upper end section 4*c* of the contact arm 4 and such that the nearly central section 21*b* thereof is engaged with the tip end section 16*a* of the switch plunger 16. Furthermore, the trigger arm 21 is configured such that in the middle of retraction the free end section 21*a* of the trigger arm 21 is disengaged from the upper end section 4*c* of the contact arm 4 as shown in FIG. 10.

The switch plunger 16 protruding downward and supported so as to be slidable up and down is provided at the central section of the trigger 20. When the switch plunger 16 is located at its bottom dead center, the driving machine 1 is maintained in its OFF state. In the course of the movement of the switch plunger 16 from its bottom dead center to its top dead center against the resistance force of the spring 17, the start switch 15 is turned ON, the motor 12 operates, and the driving machine 1 starts driving operation.

The connected fasteners 35*a* (see FIG. 7) are connected to each other via an adhesive applied to the side faces thereof. The bit guide 30 (see FIG. 1) secured to the driving machine 1 and extending downward is provided at the front end of the magazine 14 that accommodates and supports a feeding member 32 for moving the connected fasteners 35*a* forward. The feeding member 32 (see FIG. 7) is pushed toward the bit guide 30 using a spring, not shown.

As shown in FIG. 6, the bit guide 30 has a nearly plate-like shape and is provided with the feeding passage 30*a* through which the connected fasteners 35*a* inside the magazine 14 pass, and a leg receiving section 30*b* (see FIG. 7) for supporting the leg ends of the fasteners 35 is formed below the feeding passage 30*a*. Guiding convex sections 30*c* extending in parallel with the feeding passage 30*a* are provided on the front face of the bit guide 30 (see FIG. 1) so as to protrude.

The above-mentioned contact arm 4 is described further. As shown in FIG. 6, the tip end section 4*a* of the contact arm 4 has a nearly plate-like shape and is located near the feeding passage 30*a* along the left front face of the bit guide 30. The intermediate section 4*b* (see FIG. 1) of the contact arm 4 is supported so as to be slidable up and down using the bit guide 30. At the tip end section 4*a* of the contact arm 4, two guide rods 4*e* extend in the vertical direction so as to be bilaterally symmetric and are fitted on the guiding convex sections 30*c* protruding from the bit guide 30 so as to be guided. The guiding convex sections 30*c* of the bit guide 30 are positioned inside the guide grooves 4*f* of the tip end section 4*a* of the contact arm 4, whereby the tip end section 4*a* of the contact arm 4 is supported so as to be movable up and down using the bit guide 30.

The contact arm 4 is pushed toward its top dead center at all times using the spring 5 provided between the contact arm 4 and the bit guide 30. The load of the spring 5 is set so as to be smaller than the load pushed downward using the spring 17 of the switch plunger 16.

Figure 7:
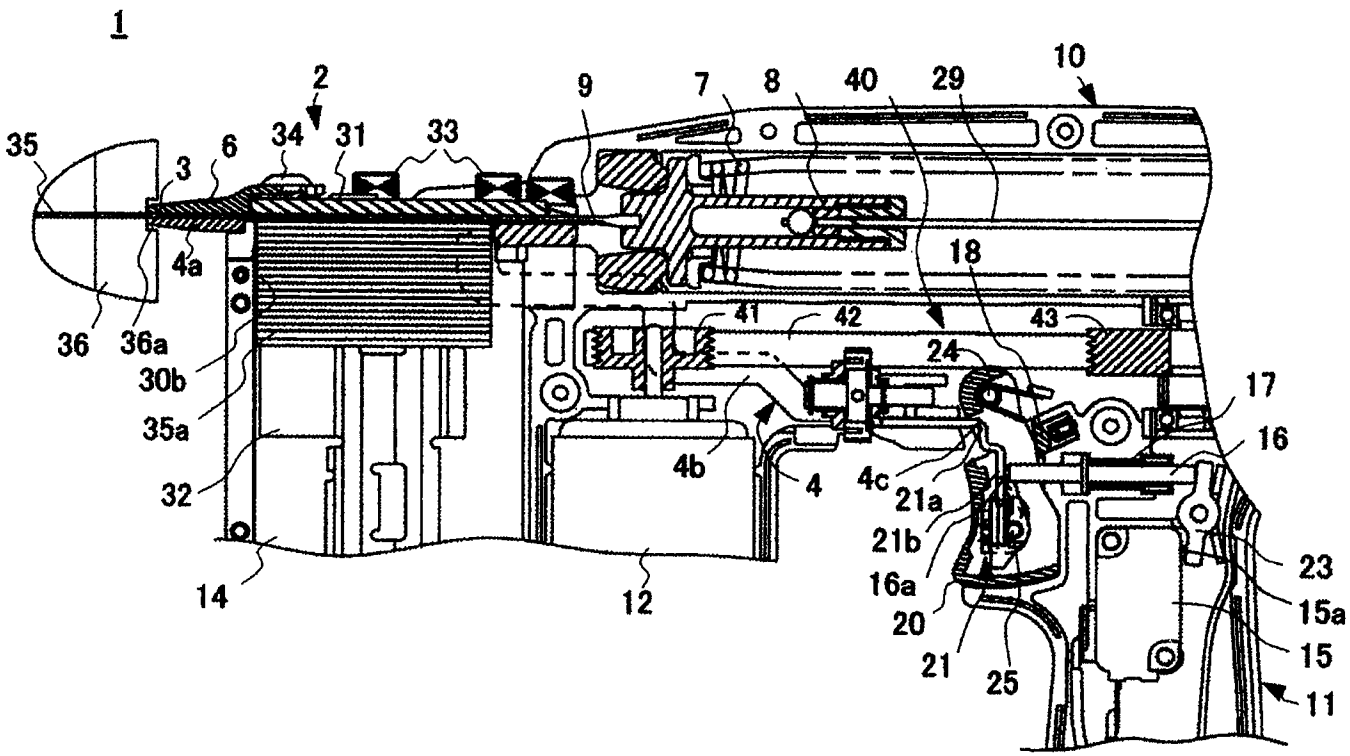
FIG. 7 is a side view showing the driving state of the driving machine shown in FIG. 1.

The feeding passage 30*a*, the guide rods 4*e* and the guide grooves 4*f* of the contact arm 4 along the front face of the bit guide 30 shown in FIG. 6 are covered with a guide plate 31 as shown in FIG. 7. The guide plate 31 is secured to the bit guide 30 using two screws 33 thread-engaged with the threaded holes provided in the bit guide 30. With this configuration, the contact arm 4 is held between the guide plate 31 and the bit guide 30 so as to be slidable up and down.

Since the guide plate 31 is installed along the front face of the feeding passage 30*a* (see FIG. 6) and receives the pushing force of a spring (not shown) applied to the feeding member 32 via the connected fasteners 35*a*, the pushing force is not exerted to the contact arm 4. Hence, the pushing force of the spring 5 for pushing up the contact arm 4 can be set so as to be small, regardless of the pushing force applied to the feeding member 32.

In this embodiment, the tip end section 4*a* of the contact arm 4 has a guide groove for allowing the driver bit 9 to move up and down. In other words, the tip end section 4*a* of the contact arm 4 is secured with a screw 34 so that the tip end section 4*a* is integrated with a nose 6 having a nearly plate-like shape and covering a part thereof to form the launching passage 3. The nose 6 is integrated with the contact arm 4 and made slidable up and down. Furthermore, as shown in FIG. 6, the tip end section 4*a* of the contact arm 4 integrated with the nose 6 is formed into a tapered shape becoming narrower downward, and the thickness of the integrated components at the lower end section thereof is set at a thickness of approximately 3.5 mm, for example, so that the lower end enters the groove 36*a* of the fastened member 36.

Next, the operation of the above-mentioned driving machine will be described below. The tip end section 4*a* of the contact arm 4, integrated with the nose 6 to form the launching passage 3, is slightly made contact with the surface of the groove 36*a* of the fastened member 36. Next, although the pushing operation of the lock switch 18 is attempted, since the convex sections 18*a* of the lock switch 18 make contact with the wall sections 20*a* of the trigger 20 in the initial state, the pulling operation of the trigger 20 cannot be carried out.

Next, when the movement operation of the lock switch 18 is carried out against the urging force of the spring 19 of the lock switch 18, the concave sections 18*b* of the lock switch 18 are moved behind the wall section 20*a* of the trigger 20, and the pulling operation of the trigger 20 is enabled. When the pulling operation of the trigger 20 is carried out to start the driving machine 1, the trigger 20 is rotated toward the switch plunger 16 around the rotating shaft 24. Hence, the pivoting section 25 of the trigger arm 21 is moved upward, whereby the central section 21*b* of the trigger arm 21 makes contact with the tip end section 16*a* of the switch plunger 16.

As a result, as shown in FIG. 7, the free end section 21*a* of the trigger arm 21 attempts to push down the upper end section 4*c* of the contact arm 4 while the tip end section 16*a* of the switch plunger 16 serves as a fulcrum and the pivoting section 25 serves as a point of application of force. However, in the case that the tip end section 4*a* of the contact arm 4 makes contact with the surface of the groove 36*a* of the fastened member 36 as shown in FIG. 7, since the lowering of the contact arm 4 is prevented, the switch plunger 16 cannot push down the contact arm 4. With this prevention of the lowering, the contact arm 4 is not moved. Hence, as the pulling operation of the trigger 20 is carried out, the switch plunger 16 is pushed up using the central section 21*b* of the trigger arm 21 while the tip end section 16*a* of the switch plunger 16 serves as a point of application of force and the pivoting section 25 serves as a fulcrum. As a result, the switch lever 23 is rotated to turn ON the switch button 15*a* of the start switch 15, the operation of the driving machine 1 is started, and the fastener 35 inside the feeding passage 30*a* is driven using the driver bit 9 from the launching passage 3 (see FIG. 7).

Figure 8:
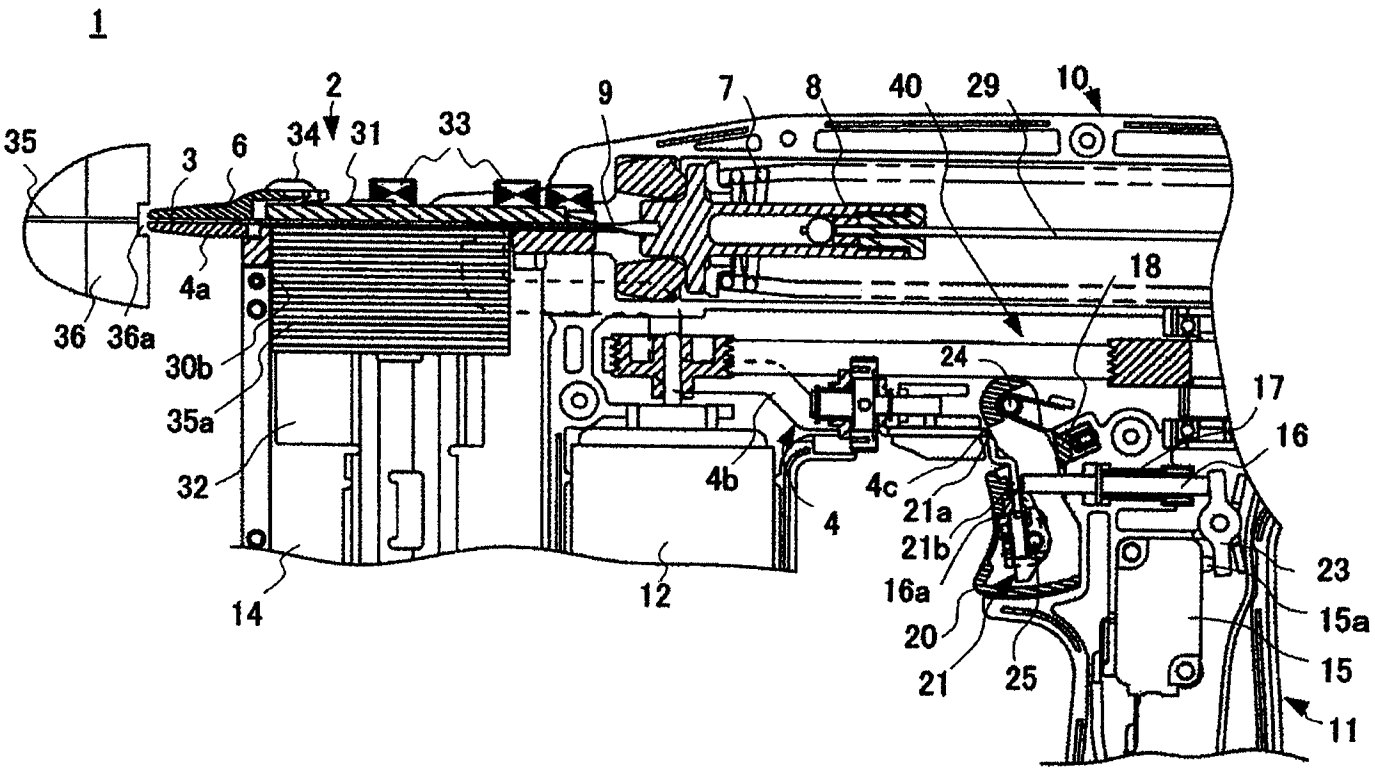
FIG. 8 is a side view showing a state immediately after the driving operation of the driving machine shown in FIG. 1.

When the fastener 35 is driven into the fastened member 36 using the driver bit 9, the driving machine 1 is moved in a direction opposite to the fastened member 36 by virtue of the reaction force of the driving operation as shown in FIG. 8. In addition, since the spring 17 pushes down the switch plunger 16 toward the free end section 21*a* of the trigger arm 21 at all times, and since this load is set so as to be larger than the load of the spring 5 that is used to push up the contact arm 4 to its top dead center, the free end section 21*a* of the trigger arm 21 pushes down the upper end section 4*c* of the contact arm 4 while the contact point between the switch plunger 16 and the trigger arm 21 serves as a point of application of force and the pivoting section 25 serves as a fulcrum (see FIG. 8).

As a result, although the driving machine 1 is moved away from the groove 36*a* of the fastened member 36, the tip end section 4*a* of the contact arm 4 is moved downward with respect to the main body of the driving machine 1 so as to make contact with the surface of the fastened member 36 at all times (see FIG. 8).

Figure 9:
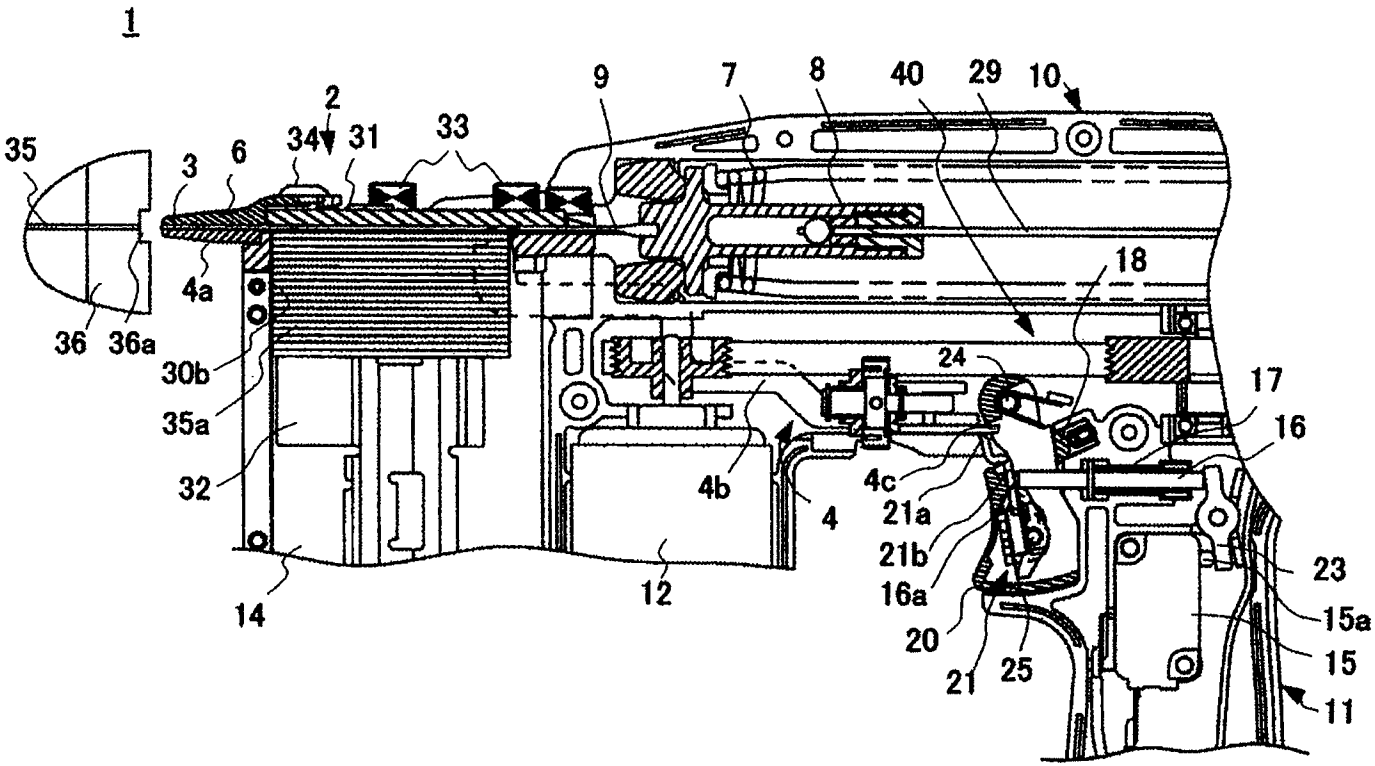
FIG. 9 is a side view showing a state in which the contact arm has been returned to its top dead center after the driving operation of the driving machine shown in FIG. 1.

When the contact arm 4 is pushed down with respect to the main body of the driving machine 1, the engagement between the upper end section 4*c* of the contact arm 4 and the free end section 21*a* of the trigger arm 21 is released in the middle of the lowering as shown in FIGS. 9 and 10. Immediately after this disengagement, the contact arm 4 is pushed using the spring 5 and returned to its top dead center. At this time, the disengaged free end section 21*a* of the trigger arm 21 makes contact with the side face section 4*d* of the contact arm 4 (see FIGS. 9 and 10).

Figure 11:
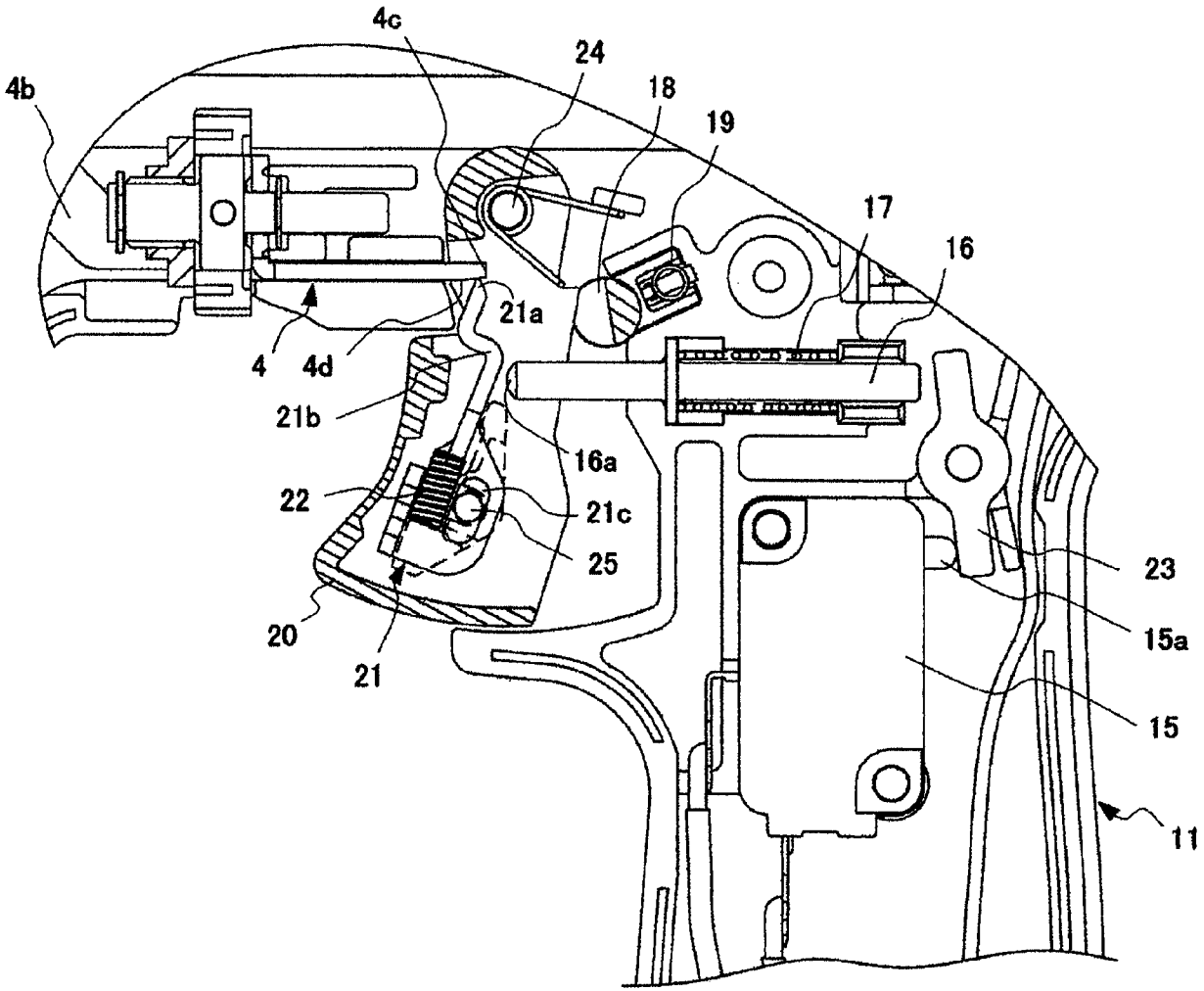
FIG. 11 is an enlarged sectional view showing a state in which the trigger is in the middle of being released in the driving machine shown in FIG. 1.
Figure 12:
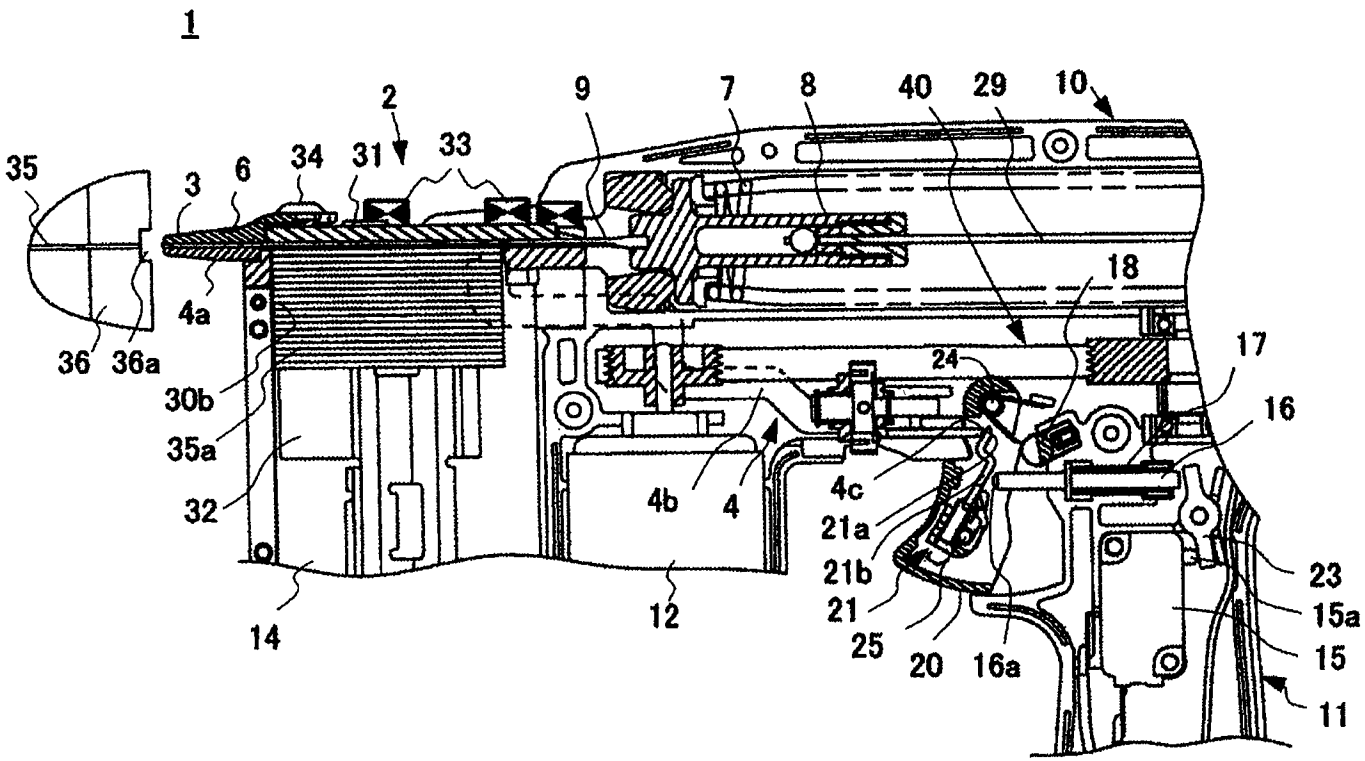
FIG. 12 is a side view showing a state in which the trigger has been released completely in the driving machine shown in FIG. 1.

Next, when the pulling operation of the trigger 20 is released, the trigger 20 is rotated around the rotating shaft 24 so as to be moved away from the switch plunger 16 via the trigger arm 21 by virtue of the spring 17 for pushing down the switch plunger 16 (see FIG. 11).

Since the trigger arm 21 is pushed forward using the spring 22 at all times, the trigger 20 is rotated. When the angle between the side face section 4*d* of the contact arm 4 and the free end section 21*a* of the trigger arm 21 reaches a certain angle, the free end section 21*a* of the trigger arm 21 slides along the side face section 4*d* of the contact arm 4 and is returned again to the engagement position. When the lock switch 18 is released completely, the lock switch 18 is returned to the position at which the pulling operation of the trigger 20 is disabled using the spring 19 for urging the lock switch 18. In other words, the lock switch 18 is automatically returned to the lock position by completely releasing the lock switch 18 (see FIG. 12).

The operation described above is carried out in the case that the fastener 35 is driven by carrying out the ordinary pulling operation of the trigger 20 while the tip end section 4*a* of the contact arm 4 is pressed against the fastened member 36. However, in the case that the fastened member 36 does not exist near the tip end section 4*a* of the contact arm 4, when the pulling operation of the trigger 20 is carried out, the operation described below is performed.

First, the movement operation of the button protruding section 18*c* of the lock switch 18 is carried out, whereby the lock switch 18 is moved from its lock position to its release position (see FIG. 4). Next, the pulling operation of the trigger 20 is carried out (see FIG. 5). Since the pivoting section 25 of the trigger arm 21 is moved by the pulling operation as described above, the central section 21*b* of the trigger arm 21 makes contact with the tip end section 16*a* of the switch plunger 16. The switch plunger 16 is pushed downward using the spring 17 at all times, and this load is set so as to be larger than the load of the spring 5 that is used to push up the contact arm 4 to its top dead center. Hence, a state similar to the state shown in FIG. 8 is obtained, the free end section 21*a* of the trigger arm 21 pushes down the upper end section 4*c* of the contact arm 4 against the load of the spring 5 while the tip end section 16*a* of the switch plunger 16 serves as a fulcrum and the pivoting section 25 serves as a point of application of force, and the contact arm 4 is moved from the top dead center to the bottom dead center against the pushing force of the spring 5 (see FIG. 8).

As a result, the switch plunger 16 remains positioned at the bottom dead center without being moved to the top dead center, whereby the start switch 15 is not turned ON. In other words, even if the movement operation for releasing the locking of the lock switch 18 and the pulling operation of the trigger 20 are attempted when work other than the driving of fasteners is performed, the driving machine 1 is not started.

As described above, when the contact arm 4 is pushed down, the engagement between the upper end section 4*c* of the contact arm 4 and the free end section 21*a* of the trigger arm 21 is released in the middle of the lowering, and the contact arm 4 is returned to its top dead center. Furthermore, when the trigger 20 is released, the free end section 21*a* of the trigger arm 21 slides along the side face section 4*d* of the contact arm 4 and is returned again to the engagement position (see FIG. 12).

Furthermore, with the present invention, the release operation and the pulling operation of the triggering means can be carried out using the hand holding the handle housing section, and the locking means can be returned to its lock position automatically by just completely releasing the hand holding the handle housing section from the pulling operation of the trigger, whereby operability can be improved.

Although the above-mentioned embodiment has been described with respect to an electric-motor-type driving machine in which an electric motor is used as a drive source, the present invention can also be applied to pneumatic-type and gas-combustion-type driving machines. Furthermore, although the present invention is applied to the so-called pushless type in which the contact arm is pushed toward its top dead center using the pushing member at all times in the above-mentioned embodiment, the present invention can also be applied to a push lever type in which the contact arm is pushed downward in its initial state. Moreover, the movable means, such as the switch plunger, can be connected to the driving means including a motor, etc. mechanically or electrically.

Although the invention made by the present inventors has been described on the basis of the embodiment thereof, the present invention is not limited to the above-mentioned embodiment, but can undergo various modifications without departing from the spirit of the invention.

What is claimed is:

1. A driving device comprising:

a driver bit for striking a fastener loaded in a launching section;

a driving device for driving the fastener from the launching section by reciprocating the driver bit;

a trigger that can be pulled in a given direction to control the start or stop of the driving device;

a locking device disposed near the trigger at a handle housing section and having a pair of wall sections that extends in parallel from the handle housing section, each wall section having a through hole;

a lock switch member extending through each through hole and slidable between a first position and a second position in a direction perpendicular to the direction of the pulling operation of the trigger, the lock switch member having a convex portion and a concave portion;

a first spring for urging the lock switch member toward the second position; and a second spring configured to urge the trigger toward a default position, wherein a wall section of the trigger is engaged with the concave portion when the lock switch member is at the first position and the pulling operation of the trigger is enabled, and the wall section of the trigger contacts the convex portion when the lock switch member is at the second position and the pulling operation of the trigger is disabled.

2. The driving device according to claim 1, further comprising a contact arm, one end of which is disposed at a tip end section of the launching section and the other end of which is mechanically connected to the trigger, wherein in the case that the contact arm makes contact with a work piece when the lock switch member is at the first position, the driving operation for the fastener is enabled by pulling the trigger.

3. The driving device according to claim 2, further comprising a third spring for urging the contact arm in a direction opposite to the launching direction of the fastener.

4. The driving device according to claim 1, wherein the driving device is equipped with an electric motor and a switch for starting the electric motor, and the trigger turns OFF the switch when the lock switch member is at the second position and turns ON the switch when the lock switch member is at the first position.

5. A driving device comprising:

a housing having a body housing section and a handle housing section;

a launching section provided at one end of the body housing section and having a launching passage;

a magazine configured to feed fasteners to the launching passage;

a driving device disposed in the body housing section and containing a driver bit for striking a fastener loaded in the launching section;

a trigger provided in the handle housing section and being able to be pulled in a given direction;

a start switch having a switch plunger disposed at a position in which the switch plunger can make contact with the trigger by the pulling operation of the trigger;

a contact arm extending from its lower end section positioned at the launching section to its upper end section positioned near the trigger;

a trigger arm rotatably supported in the trigger, part of which is disposed so as to be engageable with the switch plunger and a free end section of which makes contact with and engages with the contact arm;

a locking device disposed in the handle housing section and having a pair of wall sections that extends in parallel from the handle housing section, each wall section having a through hole;

a lock switch member extending through each through hole and slidable between a first position and a second position in a direction perpendicular to the direction of the pulling operation of the trigger, the lock switch member having a convex portion and a concave portion;

a first spring for urging the lock switch member toward the second position; and a second spring configured to urge the trigger toward a default position, wherein a wall section of the trigger is engaged with the concave portion when the lock switch member is at the first position and the pulling operation of the trigger is enabled, and the wall section of the trigger contacts the convex portion when the lock switch member is at the second position and the pulling operation of the trigger is disabled.

6. The driving device according to claim 5, further comprising a contact arm, one end of which is disposed at a tip end section of the launching section and the other end of which is mechanically connected to the trigger, wherein in the case that the contact arm makes contact with a work piece when the lock switch member is at the first position, the driving operation for the fastener is enabled by pulling the trigger.

7. The driving device according to claim 6, further comprising a third spring for urging the contact arm in a direction opposite to the launching direction of the fastener.

8. The driving device according to claim 5, wherein the driving device is equipped with an electric motor and a switch for starting the electric motor, and the trigger turns OFF the switch when the lock switch member is at the second position and turns ON the switch when the lock switch member is at the first position.

* * * * *